US006670555B2

(12) United States Patent
Ota et al.

(10) Patent No.: US 6,670,555 B2
(45) Date of Patent: Dec. 30, 2003

(54) TERMINAL

(75) Inventors: Kouji Ota, Nagoya (JP); Hiroki Hirai, Nagoya (JP); Yoshitsugu Tsuji, Nagoya (JP)

(73) Assignees: Autonetworks Technologies, Ltd., Aichi (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/350,009

(22) Filed: Jan. 24, 2003

(65) Prior Publication Data

US 2003/0155149 A1 Aug. 21, 2003

(30) Foreign Application Priority Data

Feb. 20, 2002 (JP) ..... 2002-043596

(51) Int. Cl.[7] ..... H01B 7/00

(52) U.S. Cl. ..... 174/135; 174/65 R; 439/86; 385/147

(58) Field of Search ..... 174/135, 136, 174/167, 65 R; 385/147, 137; 439/86

(56) References Cited

U.S. PATENT DOCUMENTS

| | | | | |
|---|---|---|---|---|
| 4,845,316 A | * | 7/1989 | Kaercher | 174/135 |
| 4,849,582 A | * | 7/1989 | Stevenson | 174/135 |
| 6,466,727 B1 | * | 10/2002 | Leeb | 385/137 |
| 6,573,450 B2 | * | 6/2003 | Saito et al. | 174/65 G |
| 6,590,162 B1 | * | 7/2003 | Luedicke et al. | 174/135 |

FOREIGN PATENT DOCUMENTS

| | | |
|---|---|---|
| JP | A 10-125373 | 5/1998 |
| JP | A 2002-231334 | 8/2002 |

* cited by examiner

*Primary Examiner*—Dhiru R Patel
(74) *Attorney, Agent, or Firm*—Oliff & Berridge, PLC

(57) ABSTRACT

A terminal includes a fixing section that is fixed to a vehicle body, and a removable section to which an electric wire is attached. A line of weakness is provided between the fixing section and the removable section. When the electric wire is pulled during disassembly and/or recycling of the vehicle body, the terminal breaks at the line of weakness and the electric wire can be removed from said fixing section while the fixing section remains fixed to the vehicle body.

18 Claims, 16 Drawing Sheets

TERMINAL

BACKGROUND OF THE INVENTION

1. Field of Invention

This invention relates to a terminal, for example a terminal that is crimped on an electric wire of a vehicle and secured to a mating member by a bolt.

2. Description of Related Art

Heretofore, terminals are connected to ends of electric wires arranged in an automobile. Some terminals are secured to a vehicle body by a bolt in order to ground an electric wire to the vehicle body. Other terminals that are connected to high current electric wires are connected to equipment or the like by a bolt.

For convenience of explanation, a conventional terminal will be described by referring to FIGS. 15A to 16B. FIG. 15A is a perspective view of a conventional terminal in a position before being secured to a vehicle body. FIG. 15B is a perspective view of the conventional terminal in a position after being secured to a vehicle, illustrating a problem in the terminal. FIG. 16A is a plan view of another conventional terminal. FIG. 16B is a perspective view of this other conventional terminal in a position after being secured to a vehicle, illustrating a problem in the terminal.

For example, in order to ground electric wires, as shown in FIG. 15A, ends of electric wires W are connected to terminals 1*a* and 1*b* by crimping the terminals 1*a* and 1*b* to the ends of the electric wires W. As shown in FIGS. 15A and 15B, the terminals 1*a* and 1*b* are overlapped on each other and secured to a vehicle body panel P by screwing a bolt into a bolt hole H in the panel P. Therefore, a plurality of electric wires W are together grounded to a vehicle body.

Since it is necessary to segregate and separately remove parts when disassembling a scrapped vehicle, it is required to completely remove from a vehicle body a wire harness that bundles many electric wires.

To remove the electric wire W secured to the vehicle body panel P by the bolt B, the bolt B must be removed from the panel P. In the operation of removing the wire harness from the vehicle body panel P, a hook attached to an end of a crane usually hooks the wire harness and draws the wire harness from the vehicle body. It is very troublesome and time consuming to remove the bolts one by one. Accordingly, the operation of removing the bolts from the vehicle body is usually not performed.

Therefore, when the terminals 1*a* and 1*b* are secured to the vehicle body panel P by the bolts B as shown in FIG. 15B, the electric wires W are cut off at their intermediate portions or at connection ends of the terminals 1*a* and 1*b* (so-called "under-neck position"), thereby leaving a part of the electric wires W on the panel P.

In view of the above problem, heretofore, a terminal 2 shown in FIG. 16A has been proposed. The terminal 2 has an attaching portion 2*b* with a perforated slit 2*a*. It is possible to easily remove the terminal 2 from the panel P even while the terminal 2 is secured to the panel P by the bolt B, since the slit 2*a* is broken when the terminal 2 is pulled.

However, when a plurality of terminals 2 are overlapped and secured to the panel P by the bolt B in view of workability and space efficiency, as shown in FIG. 16B, since a lower terminal 2B is covered by an upper terminal 2A, a stress is not transmitted to the slit of the lower terminal 2B when the electric wire W2 crimped in the lower terminal 2B is drawn by a hook. Therefore, instead of the slit breaking, the electric wire W2 breaks.

Additionally, when a slit is formed around the bolt hole, the fixing section is weakened and may be easily broken by a pulling force. However, even a small load such as a vibration of a vehicle may break the slit, thereby lowering the reliability of the connection.

SUMMARY OF THE INVENTION

In view of the above problems, an object of the present invention is to provide a terminal that can be secured to a vehicle body reliably while withstanding a vibration of a vehicle, can be removed from the vehicle without leaving any electric wires on the vehicle upon disassembly and/or recycling the vehicle, and can maintain a breakable function even if terminals are overlapped on each other.

In order to solve the above problems, the present invention provides a terminal that includes a base plate section, a fixing section having a bolt-passing hole and extending from the base plate section, and a removable core barrel forming section provided on one side of said base plate section. The insulator cover barrel extends from the base plate section and crimps a sheath of an electric wire. A line of weakness is provided between the removable core barrel forming section and the base plate section. The removable core barrel forming section is oriented with respect to the base plate section such that, when the removable core barrel forming section is bent about the line of weakness, the removable core barrel forming section overlaps a portion of said base plate section and forms a core barrel adjacent to said insulator cover barrel. The core barrel crimps a core of the electric wire. The line of weakness permits the removable core barrel forming section to be detached from the base section while said fixing section remains fixed by a bolt passing through said bolt-passing hole. Therefore, when the electric wire is pulled, such as during scrapping/recycling of an automobile to which the electric wire is attached, the terminal breaks at the line of weakness and the electric wire can be removed from the fixing section.

According to the above structure, the terminal may be subject to work hardening at the line of weakness when the core barrel forming section is folded with respect to the base portion at an angle of about 180 degrees. When a load is subsequently applied to the core barrel forming section in a direction that bends the core barrel forming section back away from the base portion, the terminal is easily broken at the line of weakness.

Therefore, when the electric wire is pulled during disassembly of the vehicle body, a core barrel formed by core barrel forming section and crimped on the electric wire is pulled upwardly, thereby breaking the terminal at the line of weakness. Accordingly, the electric wire can be removed from the vehicle body with the electric wire still being crimped in the core barrel, because the core barrel itself is detached from the terminal at the line of weakness. Consequently, it is unnecessary to remove the bolt to prevent the electric wire from being broken and a piece of the electric wire left attached to the vehicle body.

The terminal of the present invention is used, for example, as a ground terminal secured to a vehicle body by a bolt, or as a terminal crimped on an end of an electric power source line and secured to a bus bar in a junction box by a bolt. Upon disassembling the vehicle body, the electric wire is easily removed from a bolt-fixing section of the terminal without leaving a piece of the electric wire attached to the vehicle body or bus bar.

Since the removable core barrel forming section extends from the base plate section and is folded to overlap the base plate section, in the case where a plurality of terminals are overlapped at their fixing sections and connected to a ground at a single position, the removable portion of the lower terminal is not hidden by the fixing section of the upper terminal and the disassembly work is not inhibited.

The insulator cover barrel is narrower and/or shorter than the core barrel and has a configuration that can easily be opened when the electric wire is pulled during disassembly of the vehicle.

According to the above-described structure, when the electric wire is pulled during disassembly of the vehicle, the insulator cover barrel crimped on the electric wire can be easily removed from the electric wire. Additionally or alternatively, one or more lines of weakness could also be provided to allow the insulator cover barrel to detach from the terminal when subjected to a load due to pulling of the electric wire.

Since the electric wire is crimped in the insulation cover barrel and core barrel, the electric wire is removed from the terminal by a pulling force upon disassembly of the vehicle, but the terminal can hold the electric wire securely against a vibration of the vehicle during normal operation of the vehicle.

One or more slits and/or a groove may be provided at the line of weakness.

That is, the slits and/or groove make the line of weakness weaker against the force that occurs when the electric wire is pulled during disassembly of the vehicle body.

A clamp piece may extend from a side surface of the base plate section opposite the side from which the removable core barrel forming section extends, and the clamp piece may be bent to engage with the folded removable core barrel forming section.

Thus, since the removable core barrel forming portion is held by the clamping piece, during normal use of the vehicle (that is, at times other than the time of disassembling the vehicle), it is possible to keep the core barrel forming portion folded on the base plate section from vibrating and to steadily hold the electric wire on the base plate section.

In another aspect, the present invention provides a terminal in which a removable portion is formed at a distal end of a bolt-fixing section, and is folded at an angle of about 180 degrees with respect to the bolt-fixing section about a line of weakness.

Since the above-described terminals are provided with a removable portion, when an electric wire is pulled during disassembly of an automobile, the pulling force is directly applied to the line of weakness to break the terminal and detach the removable portion of the terminal from the bolt-fixing section of the terminal.

Two terminals may be overlapped, and electric wires connected to the respective terminals may be arranged in parallel with each other. Breakable portions of the respective terminals may be disposed at the opposite sides of overlapped fixing sections.

When the bolt-fixing sections of two or more terminals are to be overlapped, these terminals may be secured to the vehicle body at the given position with concave and convex portions around the bolt-passing holes being engaged with each other.

If two terminals overlapping each other, when two electric wires connected to the terminals are pulled either simultaneously or individually, the pulling force can be applied directly to the respective lines of weakness since the lines of weakness are not overlapped on each other. Consequently, the respective terminals can be reliably removed from the bolt-fixing sections.

BRIEF DESCRIPTION OF THE DRAWINGS

The foregoing and other features of the present invention are described in or are apparent from the following detailed description of exemplary embodiments, which refers to the accompanying drawings, wherein.

DETAILED DESCRIPTION OF PREFERRED EMBODIMENTS

Figure 1:
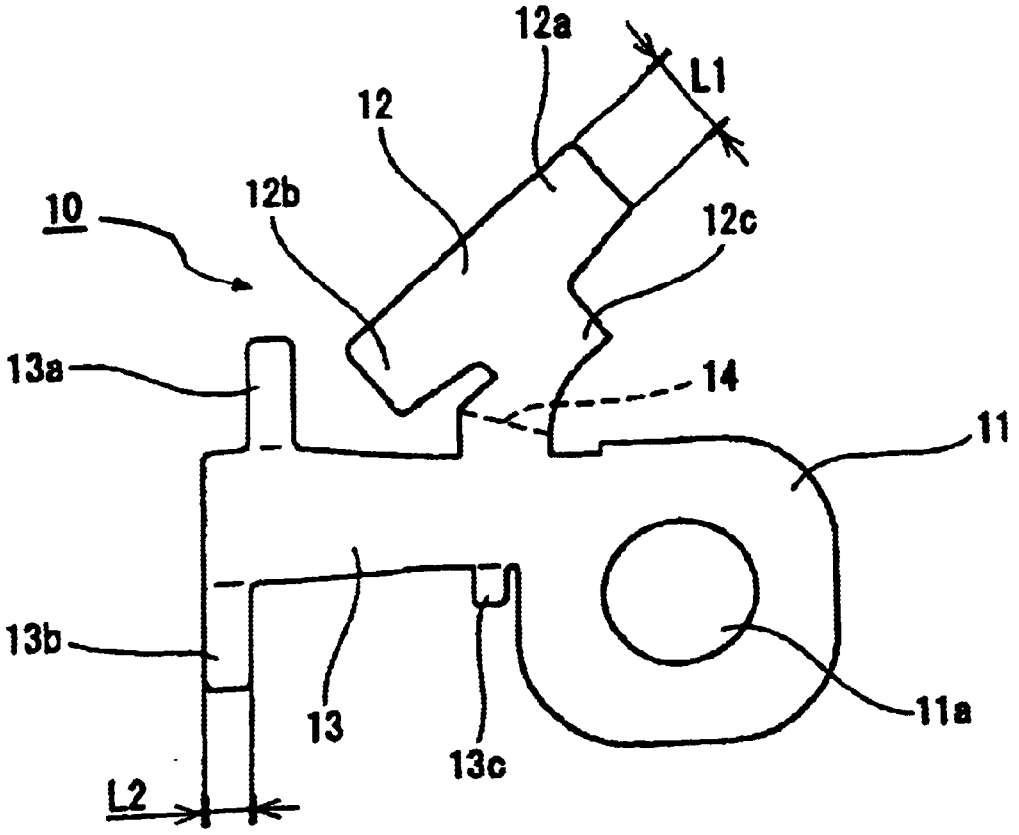
FIG. 1 is a developed view of a terminal in accordance with a first exemplary embodiment the present invention.

Referring now to the drawings, various exemplary embodiments of a terminal in accordance with the present invention will be described below.

A terminal 10 in a first exemplary embodiment, as shown in FIG. 1 by a developed view, may be formed by punching a sheet of conductive metallic plate. The terminal 10 includes a fixing section 11 having a bolt-passing hole 11 a at a central part, a base plate section 13 extending from the fixing section 11, and a removable core barrel forming section 12 extending from a side of the base plate section 13.

The removable core barrel forming section 12 is connected to the base plate section 13 via a line of weakness 14, and is folded at an angle of about 180 degrees toward the base plate section 13 about the line of weakness 14. A base plate overlapping portion 12*c* of the removable core barrel forming section 12 extends from the line of weakness 14, and projecting portions project from opposite sides of the base plate overlapping portion to form core barrels 12*a* and 12*b*.

Figure 4:
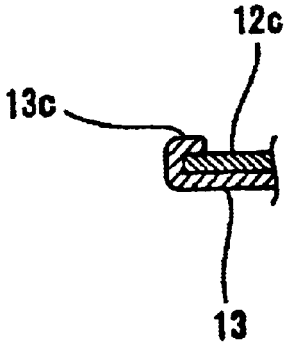
FIG. 4(A) is a cross sectional view of the terminal taken along line A—A in FIG. 2.
FIG. 4(B) is a cross sectional view of the terminal taken along line B—B in FIG. 3.
FIG. 4(C) is a cross sectional view of the terminal taken along line C—C in FIG. 3.
Figure 4:
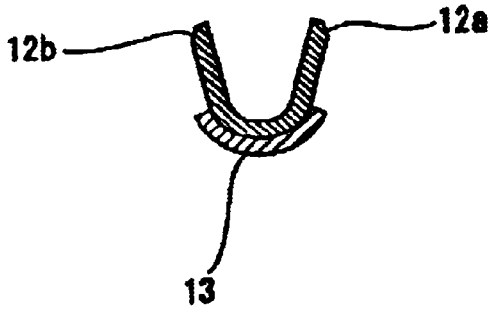
Figure 4:
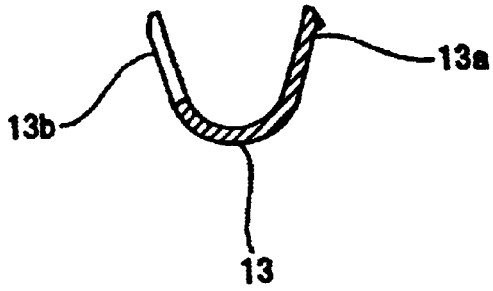

A clamping piece 13*c* projects from a side edge of the base plate section 13 opposite to the removable core barrel forming section 12. As shown in FIG. 4(A), the clamping piece 13*c* holds the base plate overlapping portion 12*c* down when the portion 12*c* is disposed on an upper surface of the base plate section 13 by folding the removable core barrel forming section 12 at the line of weakness 14 at an angle of about 180 degrees.

Insulator cover barrels 13*a* and 13*b* shown in FIG. 1 extend from opposite lateral sides at the other end of the base plate section 13. The insulator cover barrels 13*a* and 13*b* may be shifted from each other axially and each of them may have a width L2 that is narrower than a width L1 of each of the core barrels 12*a* and 12*b*.

Next, a process of assembling the terminal 10 will be described below.

Figure 2:
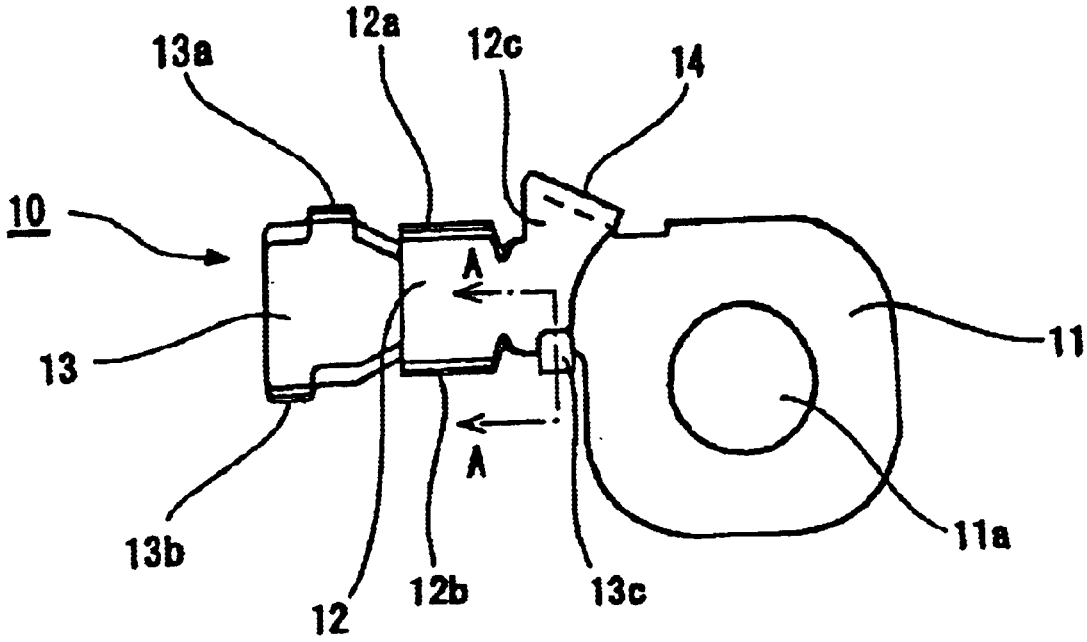
FIG. 2 is a plan view of a terminal according to the first exemplary embodiment, illustrating a removable core barrel forming section being folded.
Figure 3:
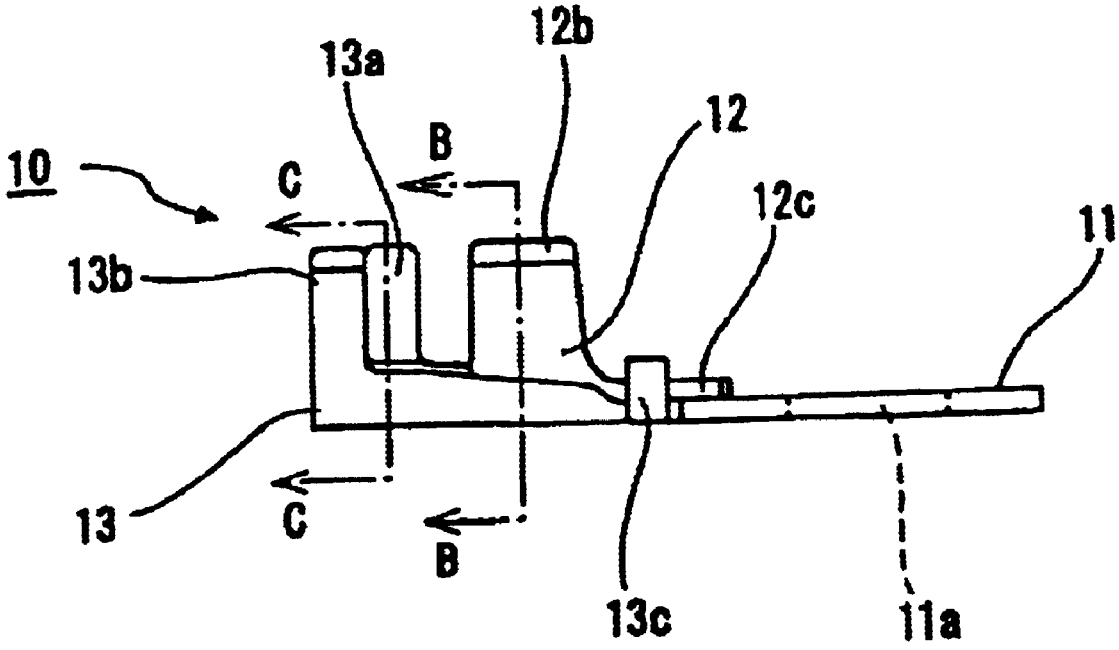
FIG. 3 is a side elevation view of a terminal according to the first exemplary embodiment, illustrating a removable core barrel forming section being folded.

As shown in FIG. 2, the base plate overlapping portion 12*c* of the removable core barrel forming section 12 is disposed on the base plate section 13 by folding the removable core barrel forming section 12 along the line of weakness 14 at an angle of about 180 degrees. As shown in FIG. 4(A), the clamping piece 13*c* holds the base plate overlapping portion 12*c* down when the clamping piece 13*c* is folded on the base plate overlapping portion 12*c*. As shown in FIGS. 4(B) and 4(C), the core barrels 12*a* and 12*b* and the insulator cover barrels 13*a* and 13*b* are bent upwardly. The insulator cover barrels 13*a* and 13*b* are shifted axially on the lateral opposite sides of the base plate section 13 and the core barrels 12*a* and 12*b* project upwardly on a front end of the base plate section 13 (the end nearest the fixing section 11). The insulator cover barrels 13*a* and 13*b* and core barrels 12*a* and 12*b* may be aligned in an axial direction.

Figure 5:
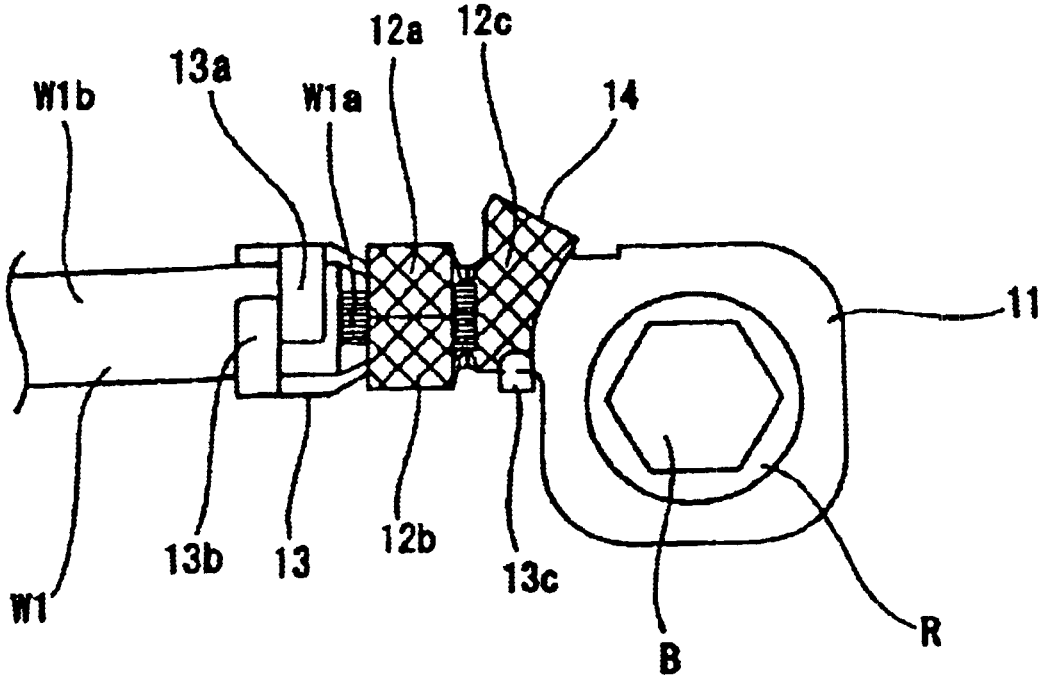
FIG. 5 is a plan view of the terminal according to the first exemplary embodiment in a position after being crimped.
Figure 6:
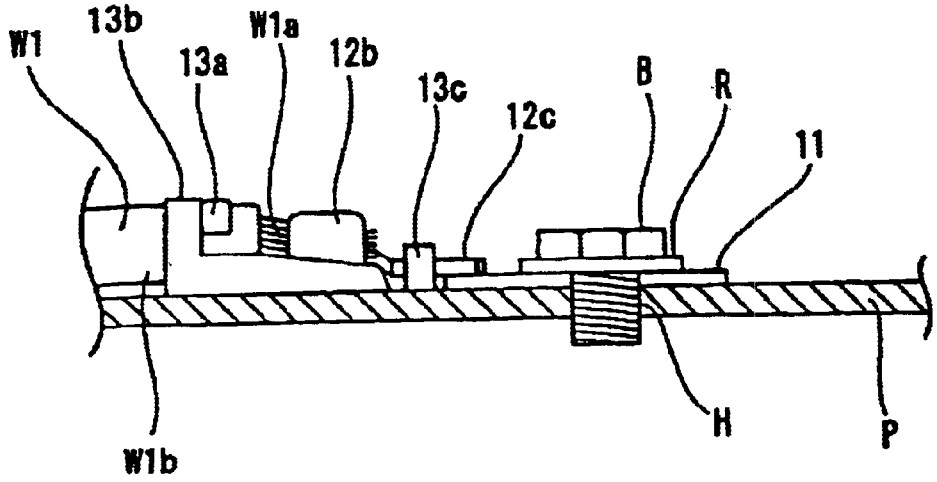
FIG. 6(A) is a side elevation view of the terminal according to the first exemplary embodiment in a position after being secured to a vehicle.
FIG. 6(B) is a side elevation view of the terminal according to the first exemplary embodiment, illustrating an electric wire being pulled away.
Figure 6:
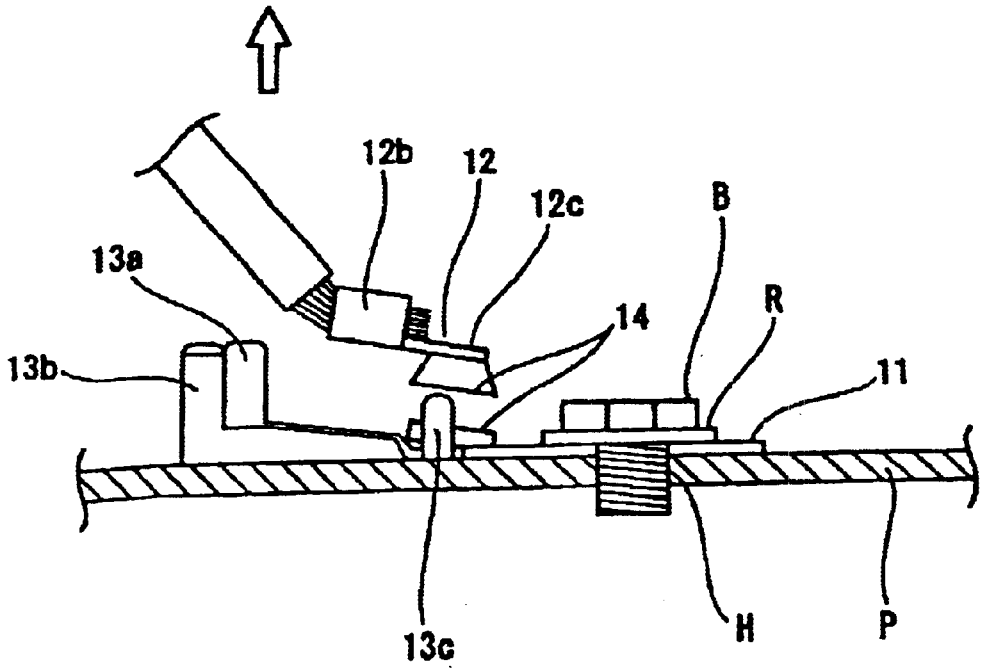

As described above, the base plate overlapping portion 12*c* of the removable core barrel forming section 12 (a shaded section in FIG. 5) is disposed on the upper surface of the base plate section 13 and the core barrels 12*a* and 12*b* (also shaded in FIG. 5) extend from opposite sides of the core barrel forming section 12. As shown in FIG. 5, an electric wire W1 constituting part of a wire harness is disposed on the base plate section 13 and the base plate overlapping portion 12*c*. As shown in FIGS. 5 and 6(A), the core barrels 12*a* and 12*b* are folded to crimp a core W1*a* exposed from an end of the electric wire W1 while the insulator cover barrels 13*a* and 13*b* are folded to crimp a sheath W1*b* of the electric wire W1.

The electric wire W1 crimped in the terminal 10 is secured to a vehicle body panel P by a bolt B. The bolt B is inserted through a washer R into a bolt-passing hole 11*a* in the fixing section 11 and a bolt hole H in the vehicle body panel P when assembling the vehicle body.

When the terminal 10 is secured to the vehicle body panel P, the electric wire W1 is strongly crimped by the core barrels 12*a* and 12*b* and is also crimped by the insulator cover barrels 13*a* and 13*b*, which may be narrower in width than the core barrels 12*a* and 12*b*. Since the insulator cover barrels 13*a* and 13*b* are shifted axially, and because they are narrower in width than the core barrels 12*a* and 12*b*, the barrels 13*a* and 13*b* can be opened more easily than the core barrels 12*a* and 12*b*. Accordingly, when the electric wire W1 is subjected to a great displacement due to a great load, the insulator cover barrels 13*a* and 13*b* are easily opened. However, when the electric wire W1 is subjected to a small displacement due to a small load caused by a vibration of the vehicle body, the insulator cover barrels 13*a* and 13*b* can continue to hold the wire W1.

Similarly, since the clamping piece 13*c* lightly holds the base plate overlapping portion 12*c* of the folded removable core barrel forming section 12, when the removable core barrel forming section 12 is subjected to a great displacement due to a great load, the clamping piece 13*c* can be easily opened. However, when the removable core barrel forming section 12 is subjected to a small displacement due to a load caused by, for example, a vibration of the vehicle body, the clamping piece 13*c* can continue to hold the base plate overlapping portion 12*c*.

Next, an operation of removing the electric wire W1 when disassembling a vehicle will be described below.

Upon disassembling the vehicle, a wire harness in which the electric wire W1 is bundled together with other electric wires may be pulled up by a crane (not shown), for example.

When the crane pulls the electric wire W1 upwardly, as shown in FIG. 6(B), the electric wire W1 is pulled up with the core barrels 12*a* and 12*b* staying crimped on the core W1*a* of the electric wire W1. The insulator cover barrels 13*a* and 13*b* that hold the electric wire W1 and the clamping piece 13*c* that holds the base plate overlapping portion 12*c* are opened (i.e., bent upwards). As the pulling force breaks the terminal 10 at the line of weakness 14 the electric wire W1 is removed together with the removable barrel forming section 12.

That is, the fixing section 11 and base plate section 13 of the terminal 10 is left on the vehicle body, and the electric wire W1 is removed together with the removable core barrel forming section 12.

At this time, since the terminal 11 is subject to work hardening at the line of weakness 14 on account of the removable core barrel forming section 12 being folded about the line of weakness 14 at an angle of about 180 degrees, the terminal 11 is easily broken at the line of weakness 14 by bending back the removable core barrel forming section 12, and the removable core barrel forming section 12 can be easily removed from the base plate 11.

Since the direction of the line of weakness 14 is inclined slightly with respect to an axial direction of the electric wire W1, the pulling force on the electric wire W1 is easily transmitted to the line of weakness 14. However, if desired, the line of weakness 14 may be parallel to the axial direction of the electric wire W1.

Figure 7:
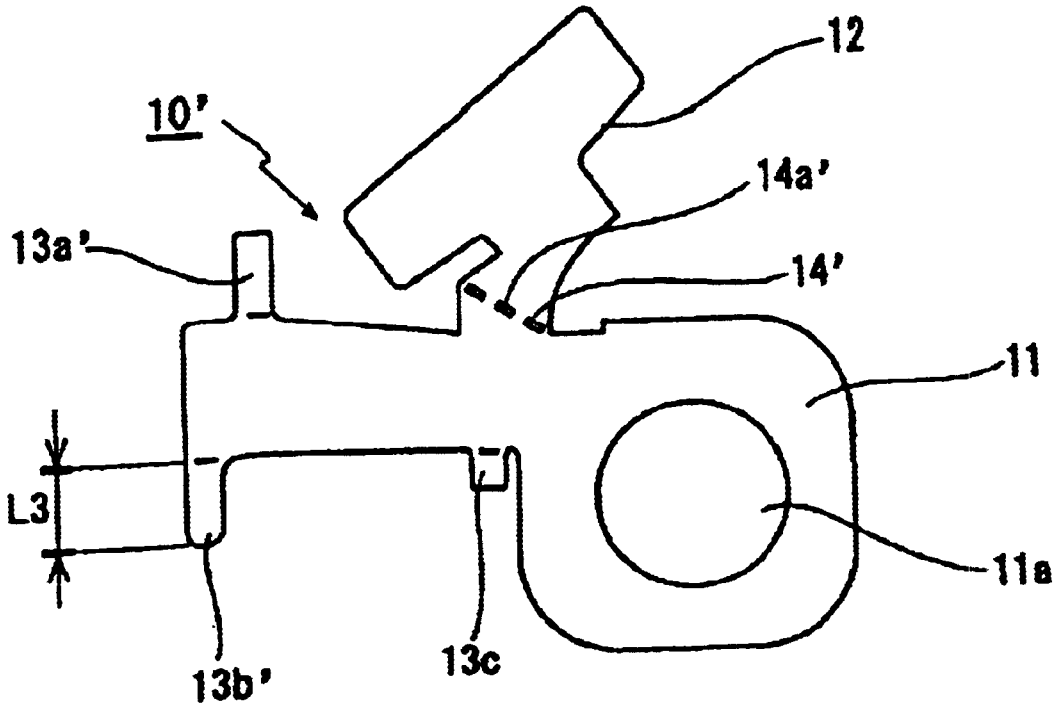
FIG. 7 is a developed view of a terminal in accordance with a second exemplary embodiment according to the present invention.

FIG. 7 shows a terminal in accordance with a second exemplary embodiment of the present invention.

The second exemplary embodiment is different from the first exemplary embodiment with respect to the fact that one or more perforated slits 14*a*' may be formed at a line of weakness 14', and lengths L3 of insulator cover barrels 13*a*' and 13*b*' may be short.

Thus, the perforated slits 14*a*' at the line of weakness 14' will make the terminal 10' more tearable at the line of weakness 14', thereby enhancing removability of an electric wire.

A groove (not shown) may be provided at the of weakness 14*a*' in lieu of or in addition to the slits 14*a*' to make the terminal 10' thinner at the line of weakness 14*a*', as seen in cross section. The grooved line of weakness 14*a*' can provide a preferable breakage effect.

Since an electric wire holding force of the insulator cover barrels 13*a*' and 13*b*' is weakened by shortening the lengths L3 of the insulator cover barrels 13*a*' and 13*b*', they can be easily opened upon pulling of the electric wire.

Figure 8:
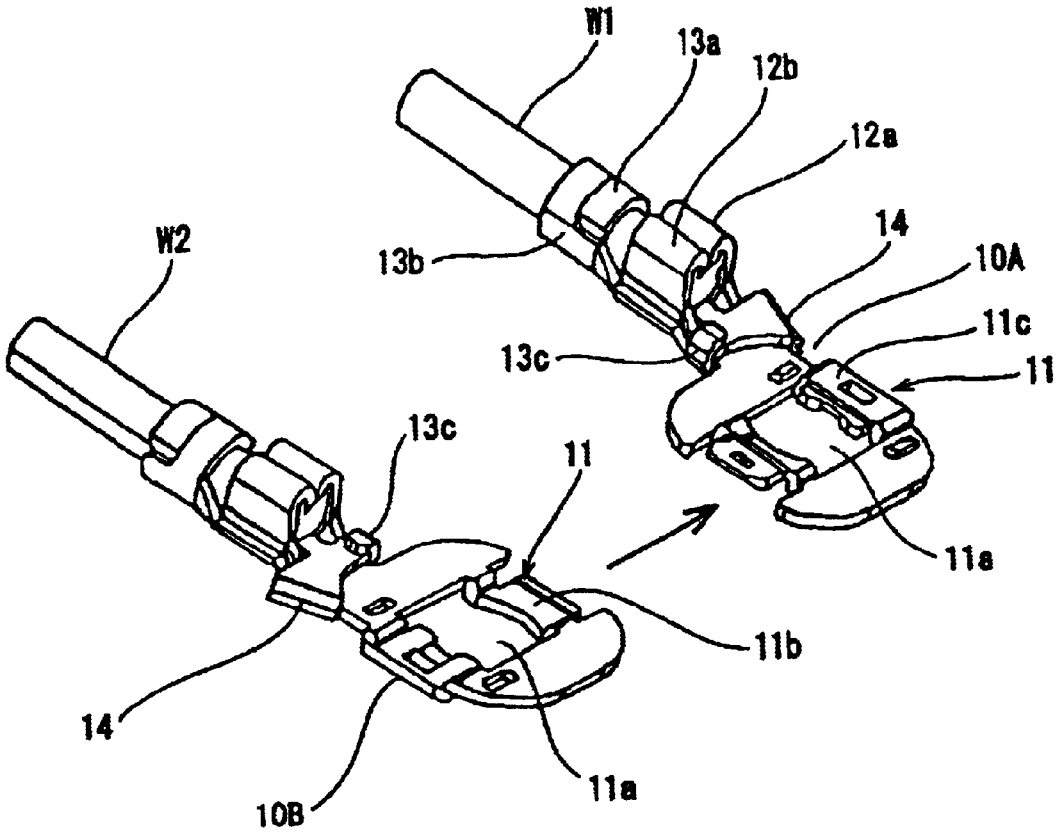
FIG. 8 is a perspective view of terminals in accordance with a third exemplary embodiment according to the present invention, illustrating terminals in a position before being assembled.
Figure 9:
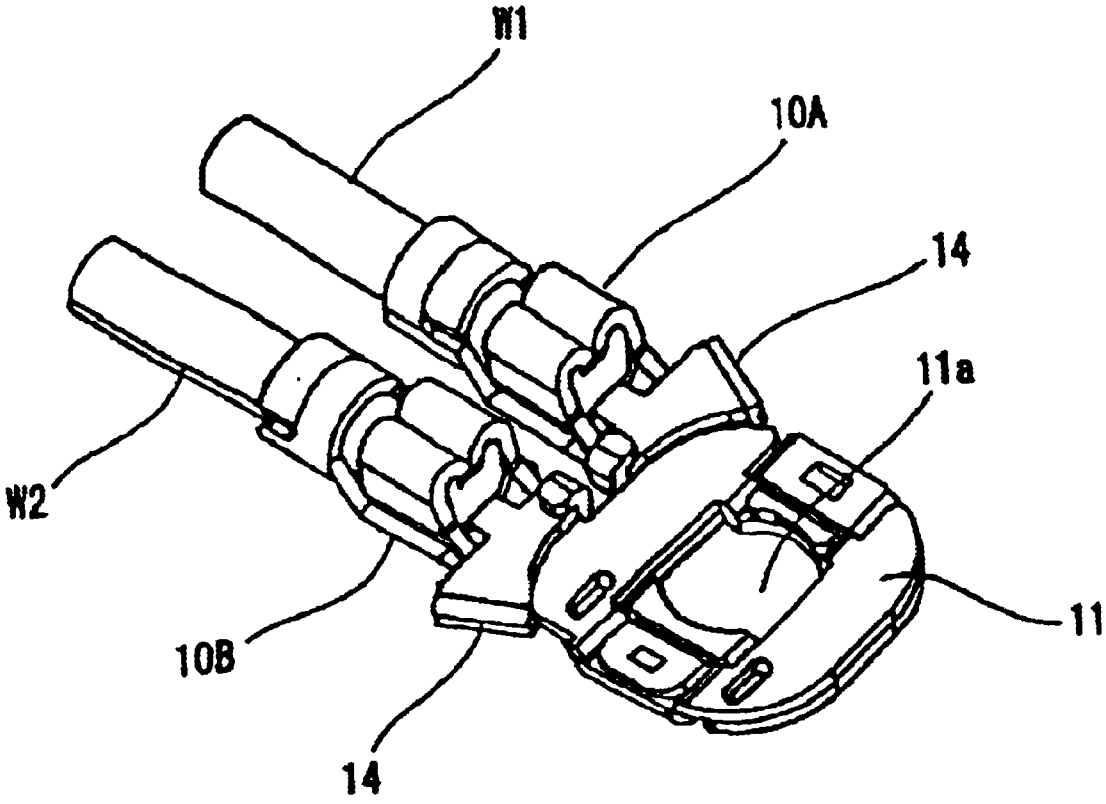
FIG. 9 is a perspective view of the terminals shown in FIG. 8 in a position after being assembled.

Next, FIGS. 8 and 9 show terminals in accordance with a third exemplary embodiment of the present invention.

The third exemplary embodiment is directed to a terminal assembly in which two terminals 10A and 10B may be overlapped on each other to connect them to a ground at a single position.

Electric wires W1 and W2 are crimped in terminals 10A and 10B, respectively. A bolt (not shown) secures overlapped fixing sections 11 to a vehicle body in a state such that the electric wires W1 and W2 in parallel with each other.

The terminals 10A and 10B are provided in their fixing sections 11 with bolt-passing holes 11*a* that are in communication with each other when overlapped, and may be provided, respectively, with a concave engaging portion 11*b* and a convex engaging portion 11*c* around the hole 11*a*. When the terminals 10A and 10B are overlapped, the concave and convex engaging portions 11*b* and 11*c* engage with each other to hold the terminals at a given rotational position. When the terminals 10A and 10B are overlapped, the lines of weakness 14 are disposed on opposite sides such that the line of weakness 14 of the lower terminal 10B is not overlapped with the line of weakness 14 of the upper terminal 10A.

Accordingly, when a pulling force is applied simultaneously to the electric wires W1 and W2 by a crane, for example, the respective 10A and 10B are readily broken at the respective lines of weakness 14, and the electric wires W1 and W2 may be removed together from the fixing sections 11, which remain secured to a vehicle body by a bolt.

Even if the electric wire W1 on the upper terminal 10A is not pulled but the electric wire W2 on the lower terminal 10B is pulled, the lower terminal 10B is broken at its line of weakness 14 without interference from the upper terminal 10A.

Figure 10:
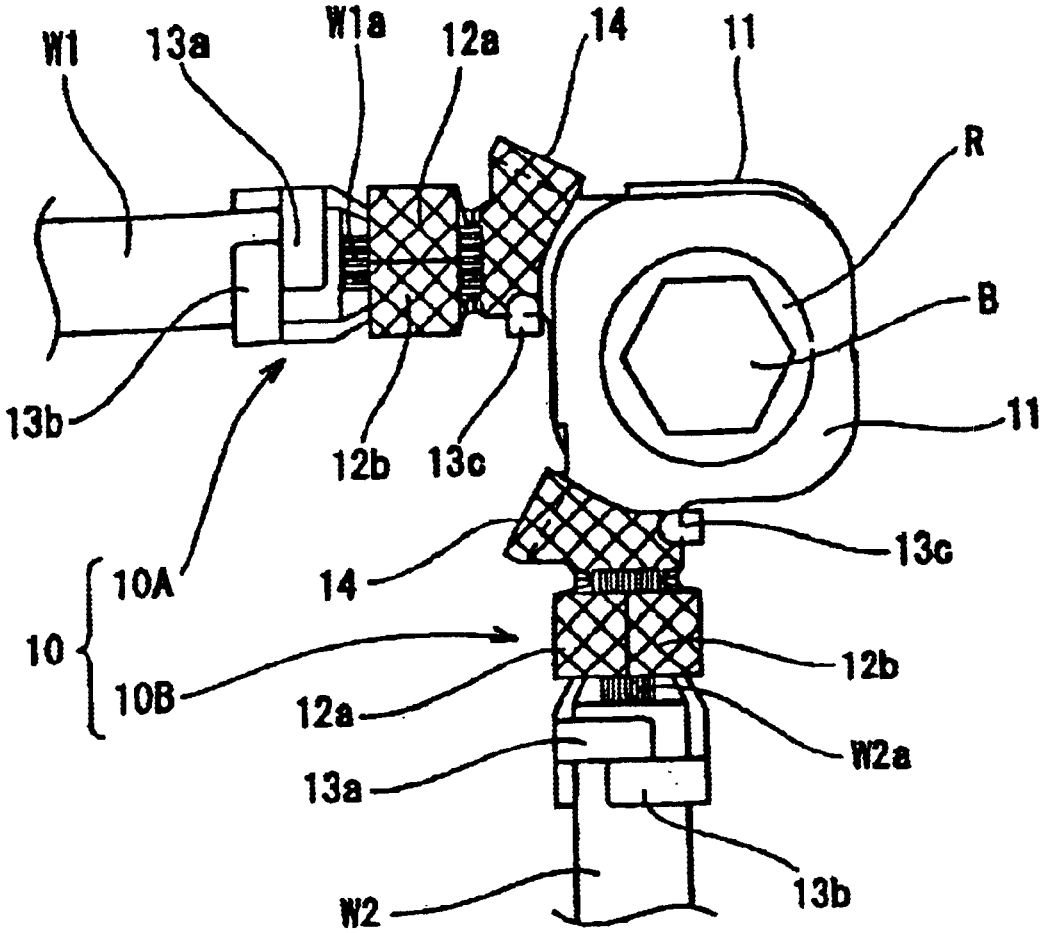
FIG. 10 is a plan view of an alteration of the third exemplary embodiment.

FIG. 10 shows an alteration of the third exemplary embodiment. The electric wires W1 and W2 connected to the upper and lower terminals 10A and 10B, respectively, intersect with each other at a right angle, for example.

In FIG. 10, the same symbols show the same portions as those in FIGS. 8 and 9 and their explanations are omitted.

In this alteration, similar to FIG. 9, when the electric wires W1 and W2 are pulled, terminals 10A and 10B may be broken simultaneously at their lines of weakness 14, or either terminal may be broken at its line of weakness 14 without interference from the other terminal.

Figure 11:
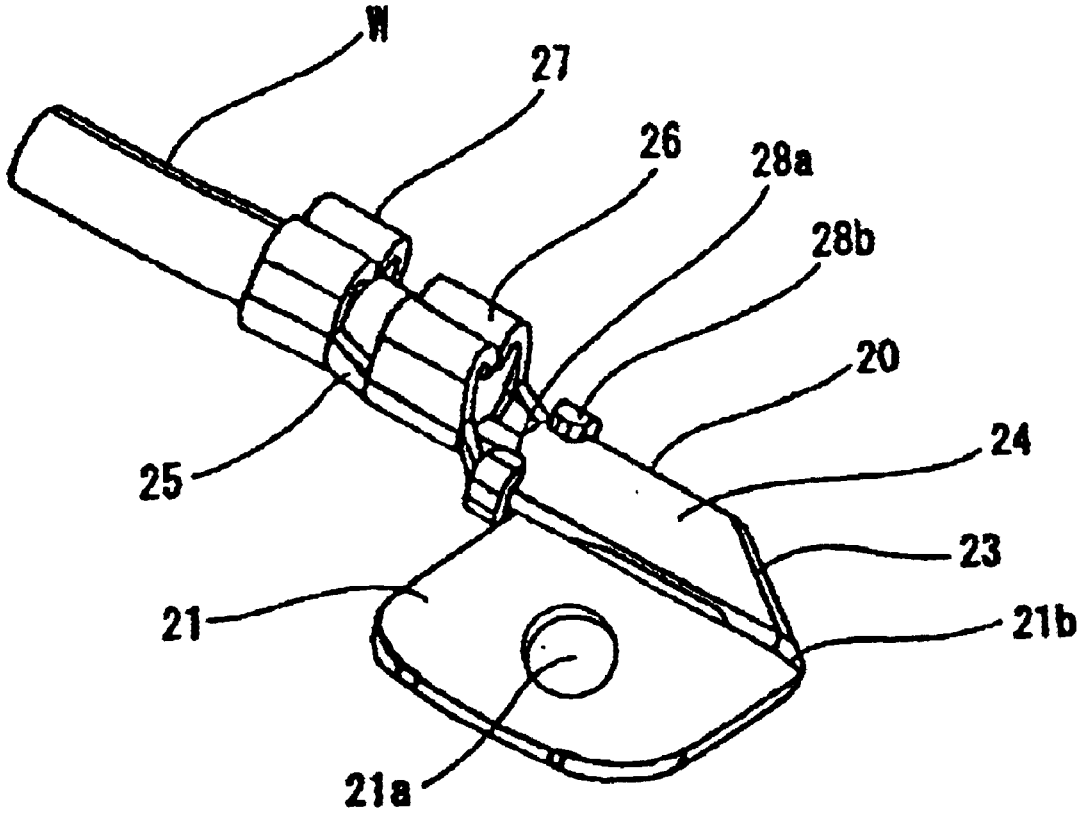
FIG. 11 is a perspective view of a terminal in accordance with a fourth exemplary embodiment according to the present invention.
Figure 12:
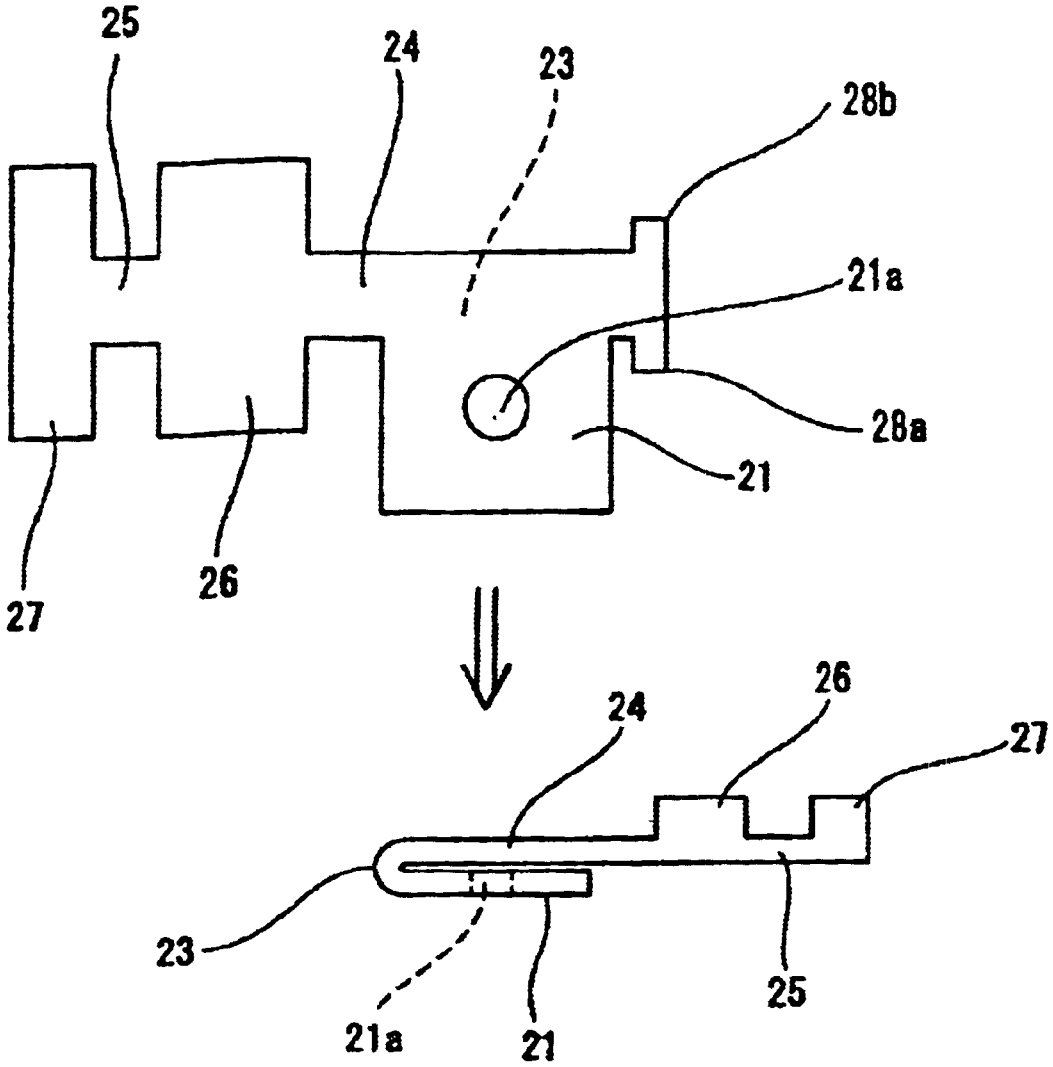
FIG. 12 is a schematic explanatory view of a manner of folding the fourth embodiment of the terminal.

FIGS. 11 and 12 show a terminal in accordance with a fourth exemplary embodiment of the present invention.

A terminal 20 in the fourth exemplary embodiment is formed by punching a sheet of conductive metallic plate in the same manner as the terminal in the first exemplary embodiment.

The terminal 20 may include a fixing section 21 having a central bolt-passing hole 21*a*, a line of weakness 23 on a side end 21*b* of the fixing section 21, and a removable portion 24 connected via the line of weakness 23 to the fixing section 21, and foldable about the line of weakness by about 180 degrees. The removable portion 24 extends from a proximal end of the fixing section 21, and is overlapped on a side of the fixing section 21 when bent about the line of weakness 23.

Core barrels 26 and insulator cover barrels 27 may be provided on a base plate section 25 for connection of an electric wire. The fixing section 21 extends from the base plate section 25 in a cantilevered manner.

The terminal 20 in the fourth exemplary embodiment is different from the terminal 10 in the first exemplary embodiment with respect to the fact that the base plate 25 for connection of the electric wire is provided on the removable portion 24, and that the insulator cover barrels 27 may be removed from the fixing section 21 together with the core barrels 26 and the electric wire W.

Thus, the pulling force applied to the electric wire W is transmitted to not only the core barrels 26 but also to the base plate section 25 and the removable portion 24 through the insulator cover barrels 27. A great force can be applied to the removable portion 24 folded at an angle of about 180 degrees about the line of weakness 23, thereby reliably removing the removable portion 24 from the fixing section 21.

Figure 13:
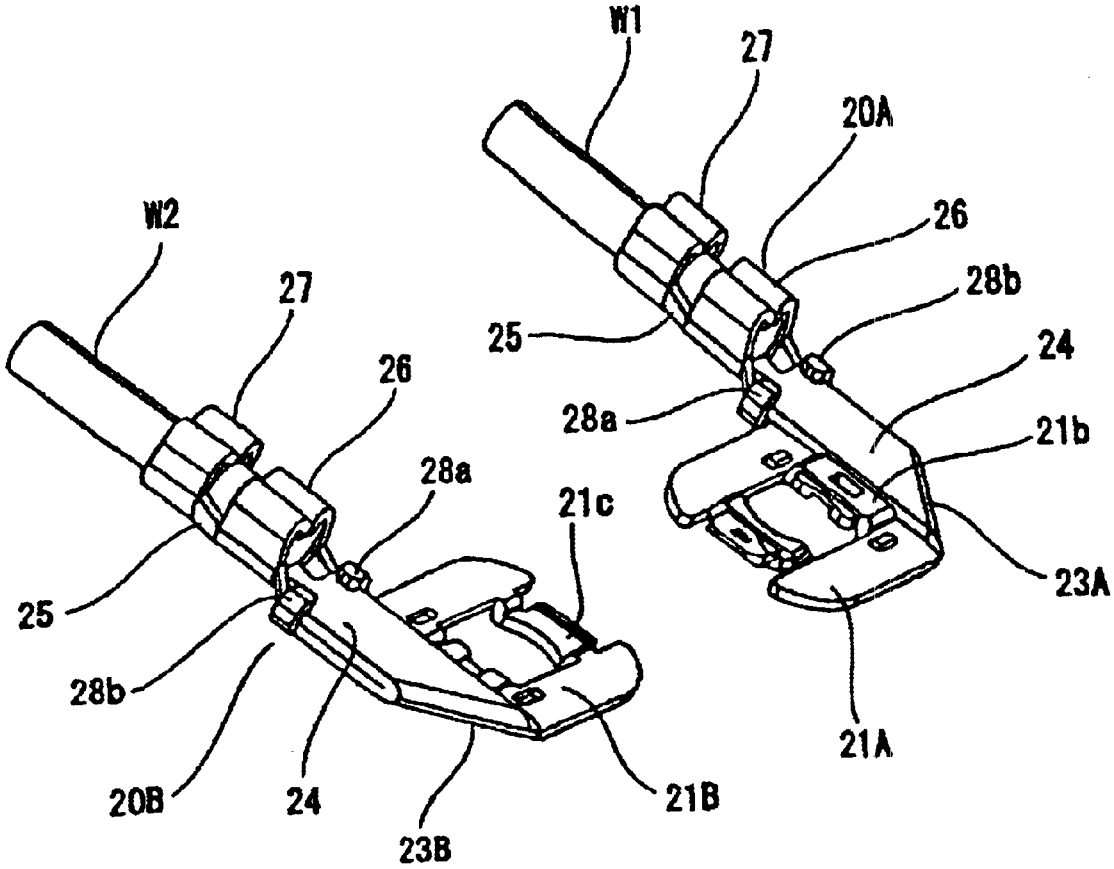
FIG. 13 is a perspective view of terminals in accordance with a fifth exemplary embodiment according to the present invention, illustrating terminals in a position before being assembled.
Figure 14:
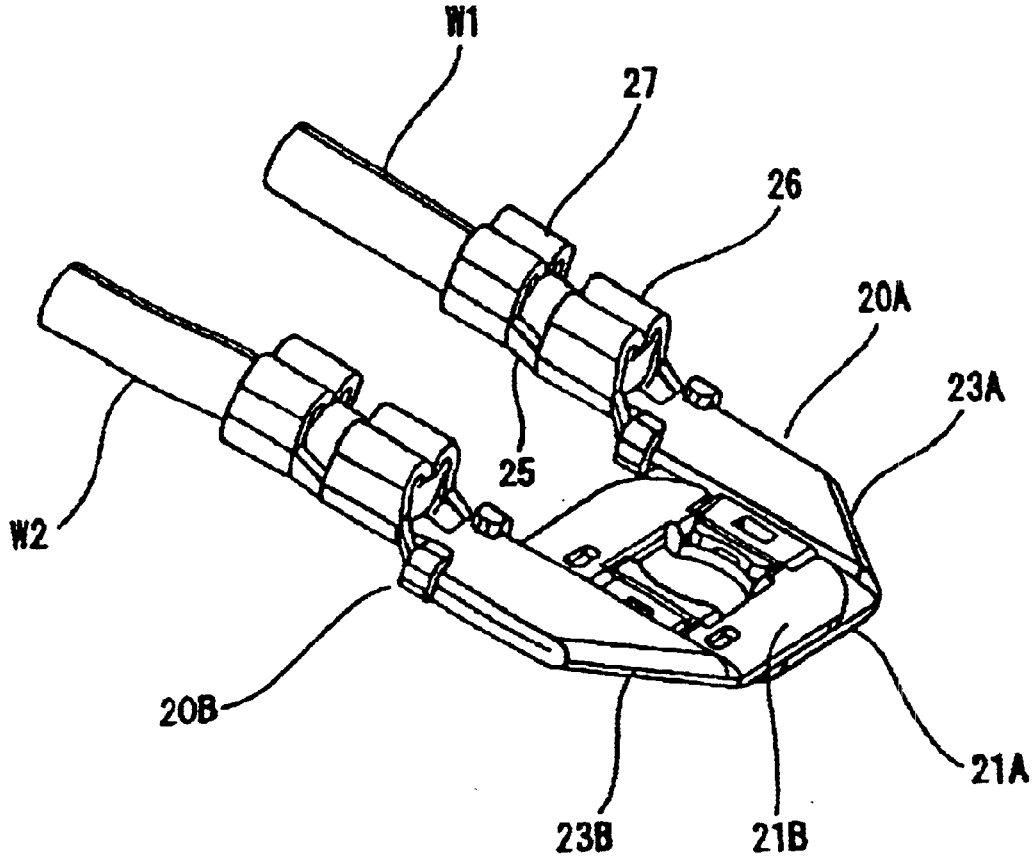
FIG. 14 is a perspective view of the terminals shown in FIG. 13 in a position after being assembled.
Figure 15:
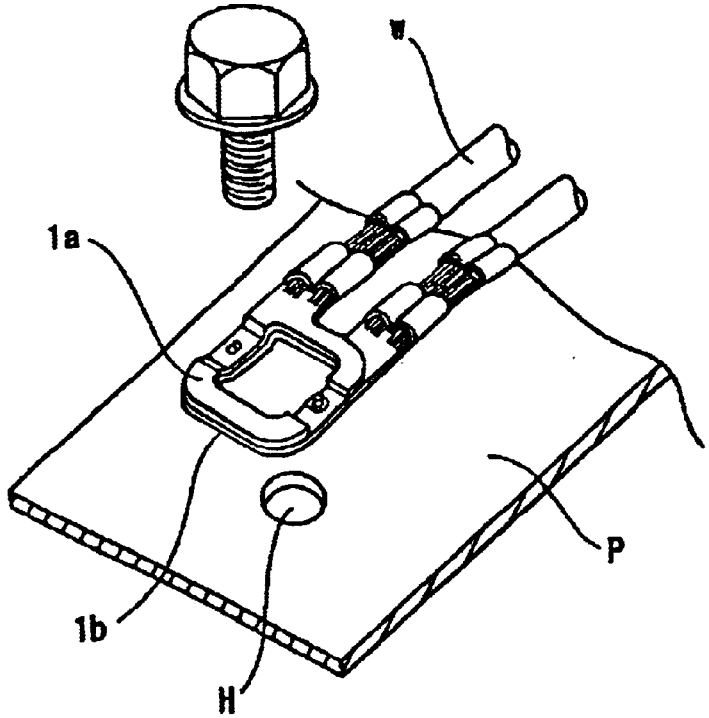
Fig. 15 (A) PRIOR ART
FIG. 15(A) is a perspective view of a conventional terminal in a position before being secured to a vehicle body.
FIG. 15(B) is a perspective view of the conventional terminal in a position after being secured to a vehicle body.
Figure 15:
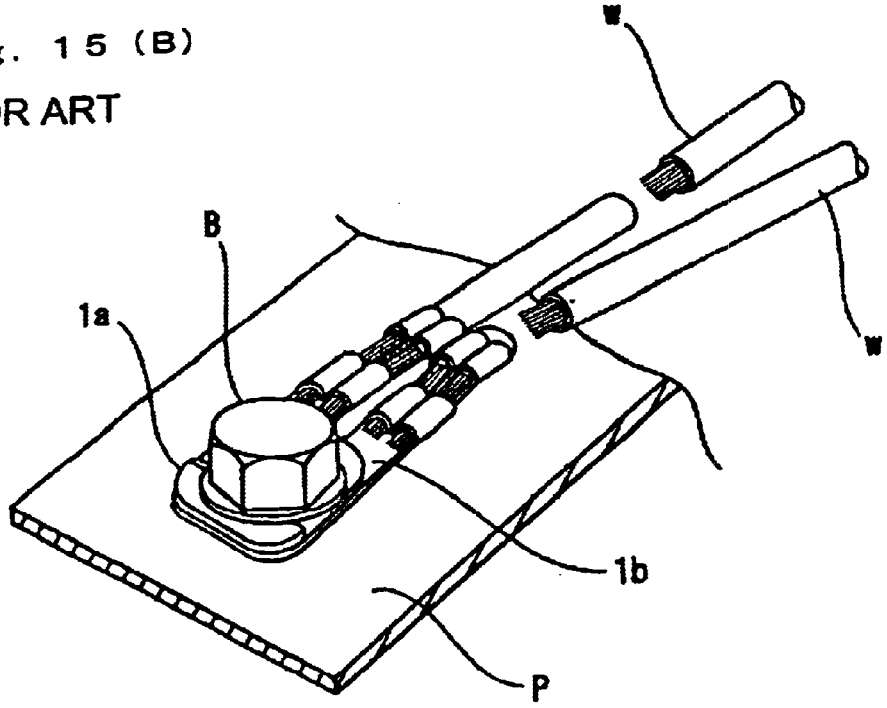
Fig. 15 (B) PRIOR ART
Figure 16:
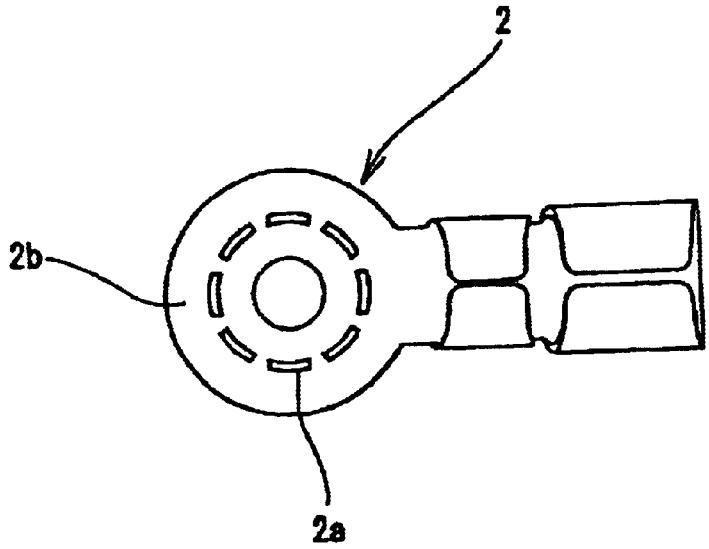
Fig. 16 (A) PRIOR ART
FIG. 16(A) is a plan view of another conventional terminal.
FIG. 16(B) is a perspective view of the other conventional terminal in a position after being secured to a vehicle body.
Figure 16:
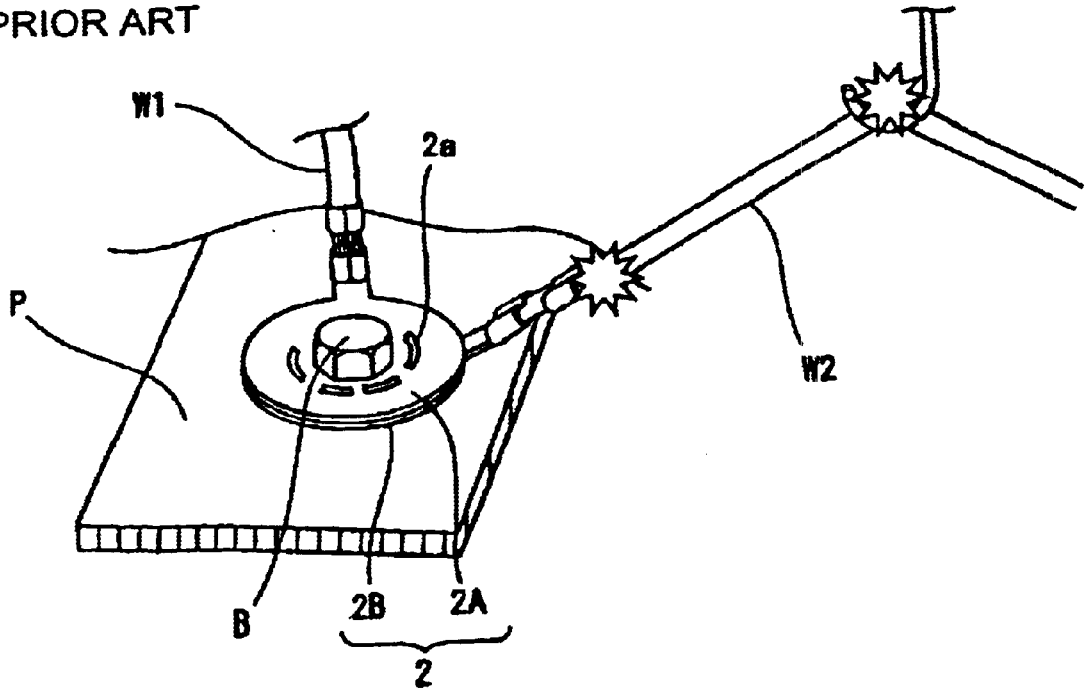
Fig. 16 (B) PRIOR ART

FIGS. 13 and 14 show a terminal assembly in accordance with a fifth exemplary embodiment of the present invention.

A terminal assembly in the fifth exemplary embodiment includes terminals 20A and 20B in the same manner as the third exemplary embodiment.

Fixing sections 21A and 21B extending from respective sides of base plate sections 25A and 25B of the terminals 20A and 20B may be overlapped, and electric wires W1 and W2 crimped in core barrels 26 and insulator cover barrels 27 of the base plate sections 25 of the terminals 20A and 20B may be arranged in parallel with each other.

The terminals 20A and 20B include the fixing sections 21A and 21B, respectively. The fixing sections 21A and 21B each have a bolt-passing hole 21*a*. The fixing section 21A has a convex portion 21*b* around its bolt-passing hole 21*a*, and the fixing section 21B has a concave portion 21*c* around its bolt-passing hole 21*a*. When the concave and convex portions 21*b* and 21*c* are engaged with each other, the removable portions 24A and 24B of the terminals 20A and 20B are disposed on opposite sides of the bolt-passing holes 21*a* that are in communication with each other.

If the terminals 20A and 20B are assembled as described above and the fixing sections 21A and 21B are overlapped and secured to a vehicle body by a bolt, the terminals 20A and 20B are readily broken at their respective lines of weakness 23A and 23B when the electric wires W1 and W2 are pulled simultaneously by, for example, a crane, and the electric wires W1 and W2 may be removed together from the fixing sections 21A and 21B secured to the vehicle body by the bolt, in the same manner as the third exemplary embodiment described above.

Even if the electric wire W1 on the upper terminal 20A is not pulled and only the electric wire W2 on the lower terminal 20B is pulled, the lower terminal 21B is broken at its line of weakness 23B of without interference from the upper terminal 20A.

Although in the above exemplary embodiments the terminals 10 and 20 may be ground terminals to be connected to a ground of the vehicle body panel P, they may be applied to any terminals to be secured to equipment by bolts. For example, the terminals 10 and 20 may be connected to ends of electric power source lines and may be connected to bus bars in an electric connection box such as a junction box or the like.

While the invention has been described in conjunction with the specific embodiments described above, many equivalent alternatives, modifications and variations may become apparent to those skilled in the art when given this disclosure. Accordingly, the exemplary embodiments of the invention as set forth above are considered to be illustrative and not limiting. Various changes to the described embodiments may be made without departing from the spirit and scope of the invention.

The entire disclosure of Japanese Patent Application No. 2002-043596 filed on Feb. 20, 2001 including the specification, claims, drawings and summary is incorporated herein by reference in its entirety.

What is claimed is:

1. A terminal comprising:

a base plate section;

a fixing section having a bolt-passing hole and extending from tbe base plate section;

an insulator cover barrel extending from the base plate section, said insulator cover barrel crimping a sheath of an electric wire; and a removable core barrel forming section provided on one side of said base plate section, a line of weakness being provided between said removable core barrel forming section and said base plate section, wherein said removable core barrel forming section is oriented with respect to said base plate section such that, when said removable core barrel forming section is bent about said line of weakness, said removable core barrel forming section overlaps a portion of said base plate section and forms a core barrel adjacent to said insulator cover barrel, said core barrel crimping a core of the electric wire; and said line of weakness permits said removable core barrel forming section to be detached from said base section while said fixing section remains fixed by a bolt passing through said bolt-passing hole.

2. A terminal according to claim 1, further comprising a clamping piece that holds said removable core barrel forming section in position after assembly.

3. A terminal according to claim 1, wherein said insulator cover barrel is shorter than said core barrel and easily opens when the electric wire is pulled in a lateral direction.

4. A terminal according to claim 1, wherein at least one of (a) one or more slits and (b) a groove is provided in said terminal at said line of weakness.

5. A terminal assembly including two terminals according to claim 1, wherein fixing sections of the two terminals overlap each other and the two terminals are mounted on a vehicle body such that the line of weakness of one terminal does not overlap the line of weakness of the other terminal.

6. A terminal assembly according to claim 5, wherein electric wires connected to the respective terminals are arranged in parallel with each other, and the lines of weakness of the respective terminals are disposed at opposite sides of the overlapped fixing sections.

7. A terminal assembly according to claim 5, wherein electric wires connected to the respective terminals are arranged substantially perpendicular to each other.

8. A terminal according to claim 1, wherein said terminal is formed by punching a sheet of conductive metallic plate.

9. A method of disassembling a vehicle provided with a wire harness including a terminal according to claim 1, comprising:

pulling the wire harness until the terminal breaks at the line of weakness.

10. A terminal according to claim 1, wherein said insulator cover barrel is narrower than said core barrel and easily opens when the electric wire is pulled in a lateral direction.

11. A terminal according to claim 1, wherein said insulator cover barrel is narrower and shorter than said core barrel and easily opens when the electric wire is pulled in a lateral direction.

12. A terminal comprising:

a fixing section having a bolt-passing hole, a removable portion connected to the fixing section, a line of weakness provided on a side end of the fixing section and the removable portion being foldable about the line of weakness such that the removable portion overlaps a side of the fixing section when bent about the line of weakness, the removable portion including a base plate section;

an insulator cover barrel extending from the base plate section, said insulator cover barrel crimping a sheath of an electric wire; and a core barrel extending from the base plate section, said core barrel crimping a core of the electric wire, wherein said line of weakness permits said removable portion to be detached from said fixing section while said fixing section remains fixed by a bolt passing through said bolt-passing hole.

13. A terminal according to claim 12, wherein at least one of (a) one or more slits and (b) a groove is provided in said terminal at said line of weakness.

14. A terminal assembly including two terminals according to claim 12, wherein fixing sections of the two terminals overlap each other and the two terminals are mounted on a vehicle body such that the line of weakness of one terminal does not overlap the line of weakness of the other terminal.

15. A terminal assembly according to claim 14, wherein electric wires connected to the respective terminals are arranged in parallel with each other, and the lines of weakness of the respective terminals are disposed at opposite sides of the overlapped fixing sections.

16. A terminal assembly according to claim 14, wherein electric wires connected to the respective terminals are arranged substantially perpendicular to each other.

17. A terminal according to claim 12, wherein said terminal is formed by punching a sheet of conductive metallic plate.

18. A method of disassembling a vehicle provided with a wire harness including a terminal according to claim 12, comprising:

pulling the wire harness until the terminal breaks at the line of weakness.

* * * * *